US011407620B2

(12) United States Patent
Ge et al.

(10) Patent No.: US 11,407,620 B2
(45) Date of Patent: Aug. 9, 2022

(54) LIFTING BEAM AND LIFTING DEVICE

(71) Applicant: JIANGSU GOLDWIND SCIENCE & TECHNOLOGY CO., LTD., Jiangsu (CN)

(72) Inventors: Zhongyuan Ge, Jiangsu (CN); Jing Fang, Jiangsu (CN)

(73) Assignee: JIANGSU GOLDWIND SCIENCE & TECHNOLOGY CO., LTD., Jiangsu (CN)

( * ) Notice: Subject to any disclaimer, the term of this patent is extended or adjusted under 35 U.S.C. 154(b) by 919 days.

(21) Appl. No.: 16/306,682

(22) PCT Filed: May 7, 2018

(86) PCT No.: PCT/CN2018/085815

§ 371 (c)(1),
(2) Date: Dec. 3, 2018

(87) PCT Pub. No.: WO2019/100666

PCT Pub. Date: May 31, 2019

(65) Prior Publication Data

US 2021/0221653 A1 Jul. 22, 2021

(30) Foreign Application Priority Data

Nov. 21, 2017 (CN) ..... 201711164414.8

(51) Int. Cl.
*B66C 13/08* (2006.01)
*B66C 1/10* (2006.01)
*B66C 1/28* (2006.01)

(52) U.S. Cl.
CPC ..... *B66C 13/08* (2013.01); *B66C 1/108* (2013.01); *B66C 1/28* (2013.01)

(58) Field of Classification Search
USPC ..... 294/67.1, 81.2
See application file for complete search history.

(56) References Cited

U.S. PATENT DOCUMENTS 3,561,810 A * 2/1971 Newsted ..... B66C 1/10 294/81.3
3,709,543 A * 1/1973 Tax ..... B66C 1/102 294/81.2

(Continued)

FOREIGN PATENT DOCUMENTS

CN 201560040 U 8/2010
CN 202030435 U 11/2011

(Continued)

OTHER PUBLICATIONS

First Australian Office Action dated Nov. 5, 2019; Appln. No. 2018274857.

(Continued)

*Primary Examiner* — Charles A Fox
*Assistant Examiner* — William J Gately, III

(57) ABSTRACT

A lifting beam and a lifting device are provided according to the embodiments of the present application. The lifting beam includes a beam body, a lifting lug adjusting member and lifting lugs, wherein the beam body extends in a first direction; the lifting lug adjusting member includes a lifting member and an adjusting member connected with each other, the lifting member is movably fitted over the beam body, and a position of the lifting member with respect to the beam body in the first direction can be adjusted by the adjusting member; and the lifting lugs are arranged on the lifting member and are located above the beam body. The lifting device includes the lifting beam. In the embodiments of the present application, the position of the lifting lugs can be adjusted according to the lifting requirements at any time, to ensure the stability of the lifting process.

13 Claims, 4 Drawing Sheets

(56) References Cited

U.S. PATENT DOCUMENTS

| | | | | |
|---|---|---|---|---|
| 4,626,012 | A | 12/1986 | Weldele | |
| 4,648,647 | A | 3/1987 | Patton | |
| 6,062,620 | A * | 5/2000 | Walker | B66C 1/10 294/67.31 |
| 2008/0129065 | A1* | 6/2008 | Alway | B66C 1/10 294/81.2 |
| 2009/0084747 | A1 | 4/2009 | Heinaman | |
| 2015/0030427 | A1 | 1/2015 | Von Lutterotti et al. | |
| 2015/0345465 | A1 | 12/2015 | Westergaard | |
| 2016/0052750 | A1* | 2/2016 | Anderson | B66C 1/10 29/428 |
| 2017/0159778 | A1* | 6/2017 | Jeng | F16H 25/2006 |

FOREIGN PATENT DOCUMENTS

| | | | |
|---|---|---|---|
| CN | 202575685 | U | 12/2012 |
| CN | 105270986 | A | 1/2016 |
| CN | 206172785 | u | 5/2017 |
| CN | 206447468 | U | 8/2017 |
| CN | 107963544 | A | 4/2018 |
| GB | 1160860 | A | 5/1968 |
| GB | 1129270 | A | 10/1968 |
| JP | 08225291 | A | 9/1996 |
| JP | 0977454 | A | 3/1997 |
| SU | 1087446 | A1 | 4/1984 |
| WO | 2015/144837 | A1 | 10/2015 |

OTHER PUBLICATIONS

Extended European Search Report dated Dec. 12, 2019; Appln. No. 18811120.7.

European Third Party Observations dated May 17, 2021; Appln No. 18811120.7.

The International Search Report dated Aug. 8, 2018; Appln. No. PCT/CN2018/085815.

* cited by examiner

LIFTING BEAM AND LIFTING DEVICE

The present application is the national phase of International Application No. PCT/CN2018/085815, titled "LIFTING BEAM AND LIFTING DEVICE", filed on May 7, 2018, which claims the priority to Chinese Patent Application No. 201711164414.8 titled "LIFTING BEAM AND LIFTING DEVICE", filed on Nov. 21, 2017 with the State Intellectual Property Office of the People's Republic of China, the entire disclosures of which applications are incorporated herein by reference.

FIELD

The present application relates to the field of lifting devices and equipment, and in particular to a lifting beam and a lifting device.

BACKGROUND

With the rapid development of wind power and increasing maturity of wind power technology in China, new models of different types are being introduced continuously, therefore, the lifting process of a wind turbine is continuously improving, and the requirements for the lifting equipment demanded in the installation of the wind turbine are getting higher and higher.

When the wind turbine is lifted, toolings are usually required for assistance. In a case that a large component of the wind turbine such as a nacelle or a generator is lifted, since the tool is required to be joined with a flange, it is required to be stable during the lifting process. Generally, by designing the toolings, the lifting process is allowed to meet the requirements for stability. In the design process, a lifting point is calculated according to a theoretical gravity center of the component to be lifted. However, in the actual manufacturing process, there is a certain deviation between the actual gravity center and the theoretical gravity center of the component to be lifted. Therefore, unbalance may occur during the lifting process, and the requirements for stability cannot be satisfied.

SUMMARY

A lifting beam and a lifting device are provided according to the present application, to further ensure the stability in the lifting process.

A lifting beam is provided according to an aspect of the present application. The lifting beam includes: a beam body extends in a first direction; a lifting lug adjusting member including a lifting member and an adjusting member connected with each other, wherein the lifting member is movably fitted over the beam body, and a position of the lifting member with respect to the beam body in the first direction is allowed to be adjusted by the adjusting member; and lifting lugs, which are arranged on the lifting lug adjusting member and are located above the beam body.

According to an aspect of the present application, the adjusting member includes: a connecting rod arranged to extend in the first direction, wherein the connecting rod includes a fixed end fixed to the beam body; and a connecting member connected to the connecting rod, wherein the connecting rod is connected to the lifting member via the connecting member in a manner that the connecting rod is movable in a vertical direction. In a case that the lifting member elastically deforms, by the action of the connecting member, at least the connecting rod can be prevented from deforming following the lifting member, thereby improving the service life of the connecting rod.

According to an aspect of the present application, the connecting member is provided with a connecting hole running through the connecting member in the first direction. The connecting hole is an oblong hole extending in the vertical direction, a connecting nut which is movable in an extending direction of the connecting hole is arranged in the connecting hole, and the connecting rod is connected to the connecting nut. The connecting rod can move along the connecting member in the vertical direction via the connecting nut, which at least prevents the connecting rod from deforming following the lifting member, thereby improving the service life of the connecting rod.

According to an aspect of the present application, inner walls, facing the connecting hole, of the connecting member are provided with sliding rails in the extending direction of the connecting hole, and the connecting nut is arranged to be movable along the sliding rails.

According to an aspect of the present application, the adjusting member further includes a pretensioning piece, and the pretensioning piece includes a first pretensioning piece and a second pretensioning piece which are used in cooperation with each other. Pretensioning ends, close to the connecting nut, of the first pretensioning piece and the second pretensioning piece provide pretensioning forces for the connecting nut, so that the connecting nut is fixed to the connecting member in the first direction. The pretensioning ends are provided with sliding rails along the extending direction of the connecting hole, and the connecting nut is movably arranged on the sliding rails. For example, the connecting nut is fixed in the connecting hole in the first direction by the first pretensioning piece and the second pretensioning piece, so as to facilitate the dismounting and mounting of the connecting nut.

According to an aspect of the present application, an accommodation space configured to accommodate the connecting nut is formed between the first pretensioning piece and the second pretensioning piece. The first pretensioning piece and the second pretensioning piece are arranged in a manner that the first pretensioning piece and the second pretensioning piece are movable with respect to each other, so that a size of the accommodation space can be changed. The first pretensioning piece and the second pretensioning piece are arranged in the manner that the first pretensioning piece and the second pretensioning piece are movable with respect to each other, which not only facilitates the mounting of the connecting nut, but also meets the requirements in using different connecting nuts, thereby expanding a use range thereof.

According to an aspect of the present application, the lifting member includes a top plate which is movable along a top surface of the lifting beam, an outer side surface of the top plate is provided with a groove, which is formed by the outer side surface of the top plate being concaved toward a bottom of the lifting member. The connecting member is arranged in the groove and is allowed to reciprocate in a concaving direction of the groove. In a case that the lifting member deforms during the lifting process, the lifting member is able to move up and down in the groove with respect to the connecting member, while a position of the connecting member does not change, thereby at least protecting the connecting rod connected to the connecting member from elastically deforming.

According to an aspect of the present application, the connecting rod is arranged at the connecting member in a manner that the connecting rod is movable in the first direction.

According to an aspect of the present application, the connecting rod is a telescopic rod which is movable in the first direction, and one end of the connecting rod opposite to the fixed end is fixed to the connecting member.

According to an aspect of the present application, the lifting member includes side plates and a through hole enclosed by the side plates, and the lifting member is fitted on an outer side of the beam body via the through hole.

According to an aspect of the present application, the beam body includes a guiding hole running through the beam body in an extending direction of the beam body, and the lifting member includes a stopping portion and a connecting portion connected with each other. The connecting portion is movably arranged in the guiding hole, and the stopping portion is arranged at an end of the connecting portion and located at a bottom of the beam body to prevent the lifting member from being detached from the beam body during a lifting process.

According to an aspect of the present application, a top outer surface of the beam body is provided with a guiding rail in the first direction, a bottom of the lifting member is provided with a guiding portion corresponding to the guiding rail, and the lifting member is arranged to be movable along the guiding rail through the guiding portion. The lifting member is arranged to be movable along the guiding rail, which can effectively reduce a driving force required when the lifting member is moved, thereby facilitating the adjustment of the position of the lifting member with respect to the beam body.

A lifting device including the lifting beam is further provided according to the present application.

In the embodiments of the present application, the beam body extends in the first direction, the lifting lugs are arranged on the lifting member, and the lifting member is able to adjust the position of the lifting member with respect to the beam body through the adjusting member, that is, a position of the lifting lugs with respect to the beam body is adjustable. Therefore, the position of the lifting lugs can be adjusted according to the lifting requirements at any time, that is, adjusting a position of a lifting point, to ensure the stability of the lifting process.

BRIEF DESCRIPTION OF THE DRAWINGS

Other features, objects and advantages of the present application will become more apparent by reading the following detailed description of non-limiting embodiments made with reference to the drawings, in which the same or similar reference numerals indicate the same or similar features.

Figure 1:
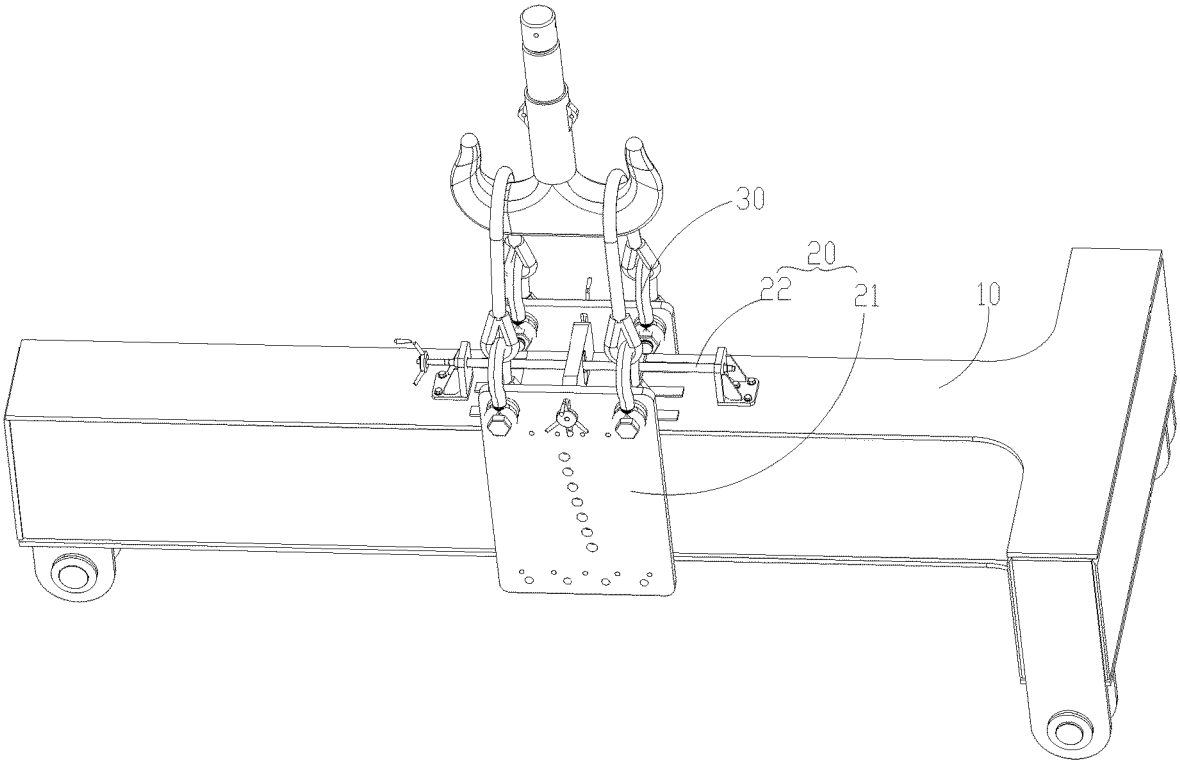
FIG. 1 is a schematic view showing the structure of a lifting beam according to an embodiment of the present application.

Reference numerals in the drawings:

| | | | |
|---|---|---|---|
| 10 | beam body, | 11 | guiding hole, |
| 12 | guiding rail, | 20 | lifting lug adjusting member, |
| 21 | lifting member, | 211 | groove, |
| 212 | stopping portion, | 213 | connecting portion, |
| 214 | guiding portion, | 22 | adjusting member, |
| 221 | connecting rod, | 221a | fixed end, |
| 222 | connecting member, | 222a | connecting hole, |
| 222b | connecting nut, | 223 | first pretensioning piece, |
| 224 | second pretensioning piece, | 225 | sliding rail, |
| 226 | pretensioning end, | 30 | lifting lug. |

DETAIL DESCRIPTION OF EMBODIMENTS

Features in various aspects and exemplary embodiments of the present application are described in detail below. In the following detailed description, numerous specific details are set forth in order to provide thorough understanding of the present application. However, it is obvious to those skilled in the art that the present application may be implemented without some of these specific details. The following descriptions of the embodiments are merely intended to provide better understanding of the present application by illustrating examples of the present application. The present application is not limited to any specific configuration and algorithm presented hereinafter; and any modification, replacement and improvement of elements, components and algorithms are covered in the scope of the present application without departing from the spirit of the present application. In the drawings and the following description, well-known structures and techniques are not illustrated to avoid unnecessarily obscuring the present application.

FIG. 1 is a schematic view showing the structure of a lifting beam according to an embodiment of the present application, the lifting beam includes: a beam body 10 extending in a first direction; a lifting lug adjusting member 20 including a lifting member 21 and an adjusting member 22 connected with each other, wherein the lifting member 21 is movably fitted over the beam body 10, and a position of the lifting member 21 with respect to the beam body 10 in the first direction is allowed to be adjusted by the adjusting member 22; and lifting lugs 30 arranged above the beam body 10. In the embodiments of the present application, the beam body 10 extends in the first direction, the lifting lugs 30 are arranged on the lifting member 21, and the lifting member 21 is able to adjust the position of the lifting member with respect to the beam body 10 through the adjusting member 22, that is, a position of the lifting lugs 30 with respect to the beam body 10 is adjustable. Therefore, the position of the lifting lugs 30 can be adjusted according to the lifting requirements at any time, that is, adjusting a position of a lifting point, to ensure the stability of a lifting process.

Figure 2:
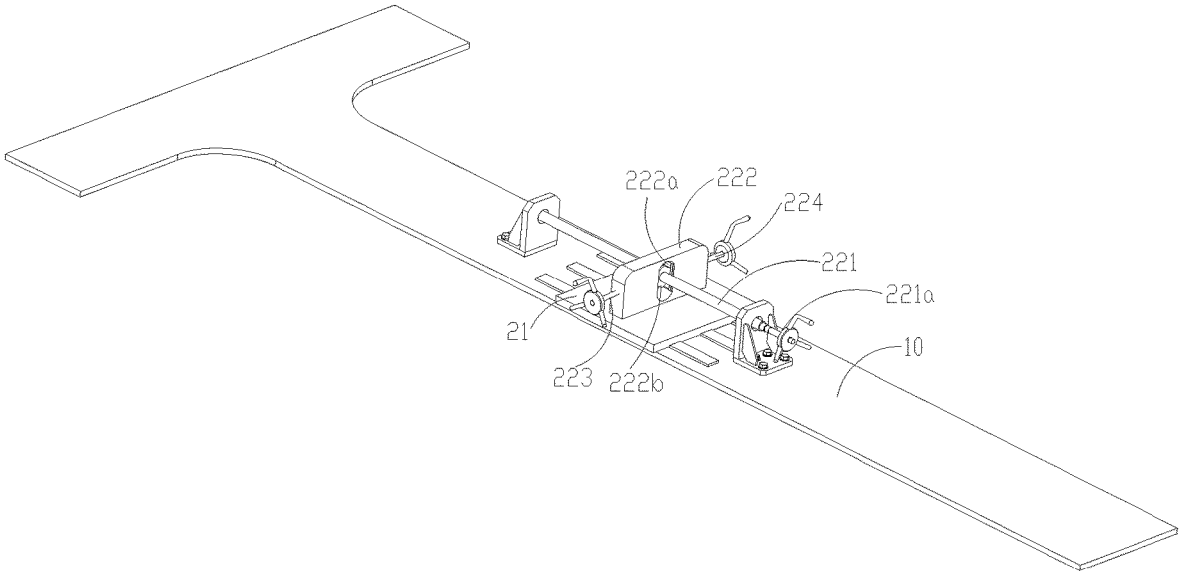
FIG. 2 is a schematic view showing a partial structure of a lifting beam according to the embodiment of the present application.

Referring to FIG. 2, in some optional embodiments, the adjusting member 22 includes: a connecting rod 221 extending in the first direction, wherein the connecting rod 221 includes a fixed end 221*a* fixed to the beam body 10; and a connecting member 222 connected to the connecting rod 221, wherein the connecting rod 221 is connected to the lifting member 21 via the connecting member 222 in a manner that the connecting rod 221 is movable in a vertical direction. During the lifting process, since an object to be lifted is heavy, the lifting member 21 may elastically deform, causing deformation of the connecting rod 221 connected to the lifting member 21, thereby affecting the service life of the connecting rod 221. In the embodiment, the connecting rod 221 is connected to the lifting member 21 via the connecting member 222 in a manner that the connecting rod 221 is movable in the vertical direction, in this case, when the lifting member 21 elastically deforms, by the action of the connecting member 222, the connecting rod 221 can be prevented from deforming following the lifting member 21, thereby improving the service life of the connecting rod 221.

Figure 3:
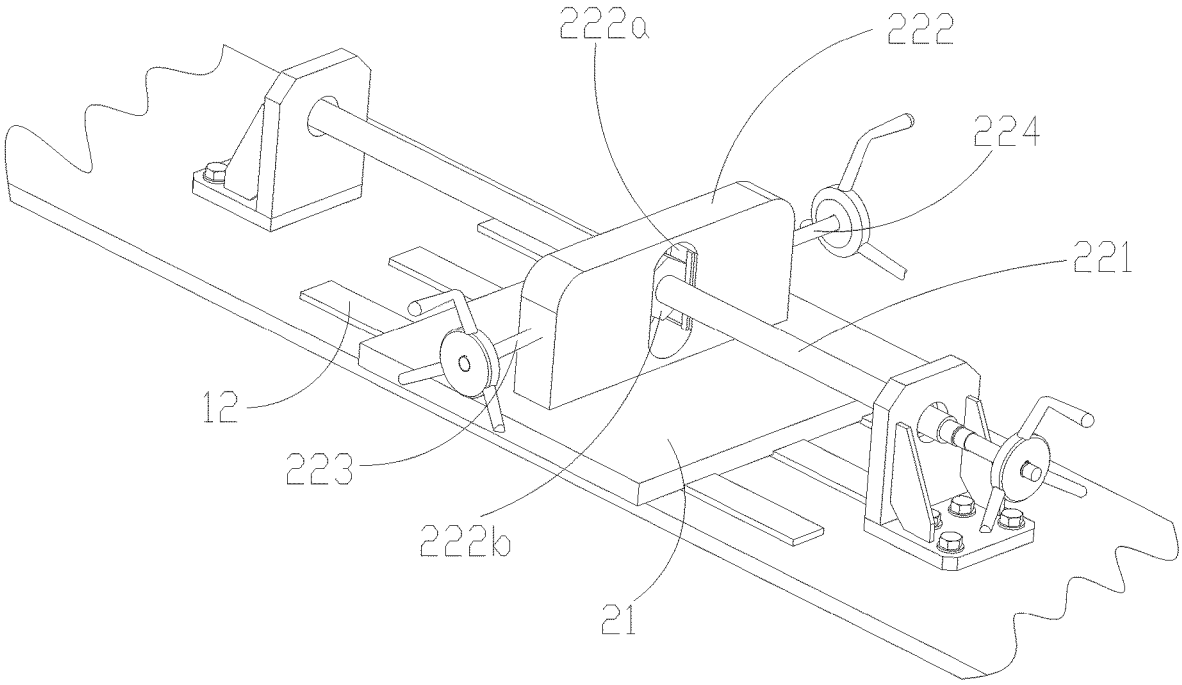
FIG. 3 is a partially enlarged view of FIG. 2.
Figure 4:
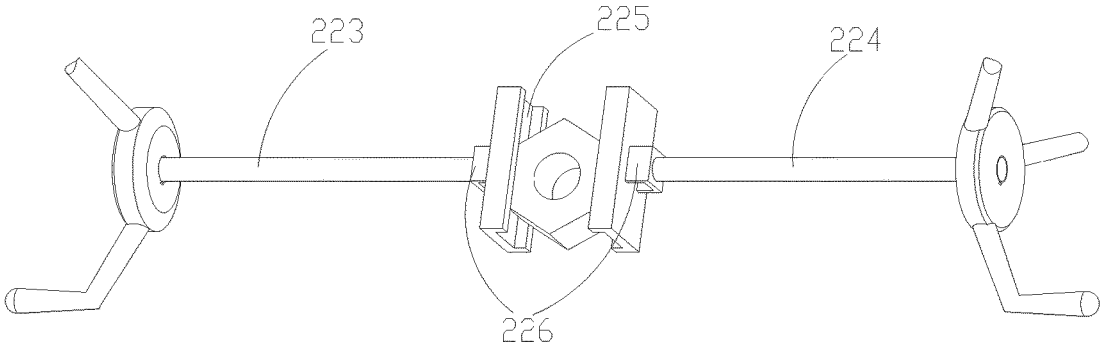
FIG. 4 is a schematic view showing the structure of a pretensioning piece of the lifting beam according to the embodiment of the present application.
Figure 5:
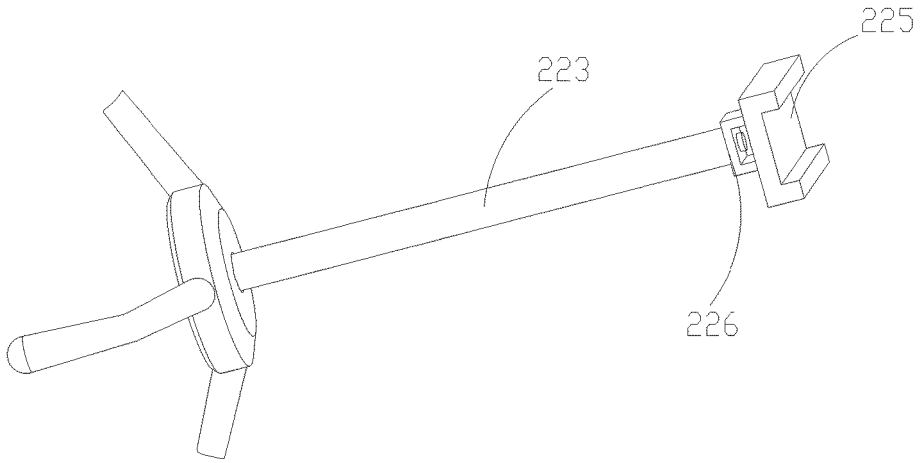
FIG. 5 is a schematic view showing the structure of a first pretensioning piece of the lifting beam according to the embodiment of the present application.

Referring to FIGS. 3 to 5, in some optional embodiments, the connecting member 222 is provided with a connecting hole 222*a* running through the connecting member 222 in the first direction. The connecting hole 222*a* is an oblong hole extending in the vertical direction, a connecting nut 222*b* which is movable in an extending direction of the connecting hole is arranged in the connecting hole 222*a*, and the connecting rod 221 is connected to the connecting nut 222*b*. In the optional embodiments, the connecting rod 221 can move along the connecting member 222 in the vertical direction via the connecting nut 222*b*, which prevents the connecting rod 221 from deforming following the lifting member 21, thereby improving the service life of the connecting rod 221. There are various manners for arranging the connecting member 222. Herein, in order to simplify the structure of the lifting beam, the connecting member 222 is configured to be plate-shaped, and a longitudinal direction of the connecting member 222 is perpendicular to the first direction, which facilitates the arrangement of the connecting hole 222*a*.

It can be understood that, there are various embodiments in which the nut is arranged to be movable in the extending direction of the connecting hole 222*a*. For example, inner walls, facing the connecting hole 222*a*, of the connecting member are provided with sliding rails 225 in the extending direction of the connecting hole 222*a*, and the connecting nut 222*b* is arranged to be movable along the sliding rails 225. In order to facilitate mounting and dismounting of the connecting nut 222*b*, the adjusting member 22 further includes a pretensioning piece, and the pretensioning piece includes a first pretensioning piece 223 and a second pretensioning piece 224 which are used in cooperation with each other. Pretensioning ends 226, close to the connecting nut 222*b*, of the first pretensioning piece 223 and the second pretensioning piece 224 are located in the connecting hole 222*a*, to provide pretensioning forces for the connecting nut 222*b*, so that the connecting nut 222*b* is fixed to the connecting member 222 in the first direction. The pretensioning ends 226 are provided with sliding rails 225 along the extending direction of the connecting hole 222*a*, and the connecting nut 222*b* is movably arranged on the sliding rails 225.

In some optional embodiments, an accommodation space configured to accommodate the connecting nut 222*b* is formed between the first pretensioning piece 223 and the second pretensioning piece 224. The first pretensioning piece 223 and the second pretensioning piece 224 are arranged in a manner that the first pretensioning piece and the second pretensioning piece are movable with respect to each other, so that a size of the accommodation space can be changed, which not only facilitates the mounting of the connecting nut 222*b*, but also meets the requirements in using different connecting nuts 222*b*, thereby expanding a use range thereof. It can be understood that, the first pretensioning piece 223 and the second pretensioning piece 224 may be connected to the connecting member 222 in various manners.

For example, the connecting member 222 is provided with a pretensioning hole, and the pretensioning hole is provided with internal threads. The first pretensioning piece 223 and the second pretensioning piece 224 are rod-shaped, and the outer side surfaces of the first pretensioning piece 223 and the second pretensioning piece 224 are provided with external threads matching with the pretensioning hole. The first pretensioning piece 223 and the second pretensioning piece 224 are connected to the pretensioning hole by threaded connection, and the mounting and dismounting of the connecting nut 222*b* are achieved by screwing the first pretensioning piece 223 and the second pretensioning piece 224. In order to facilitate the screwing of the first pretensioning piece 223 and the second pretensioning piece 224, adjusting handles are arranged on ends, away from the connecting nut 222*b*, of the first pretensioning piece 223 and the second pretensioning piece 224.

Figure 6:
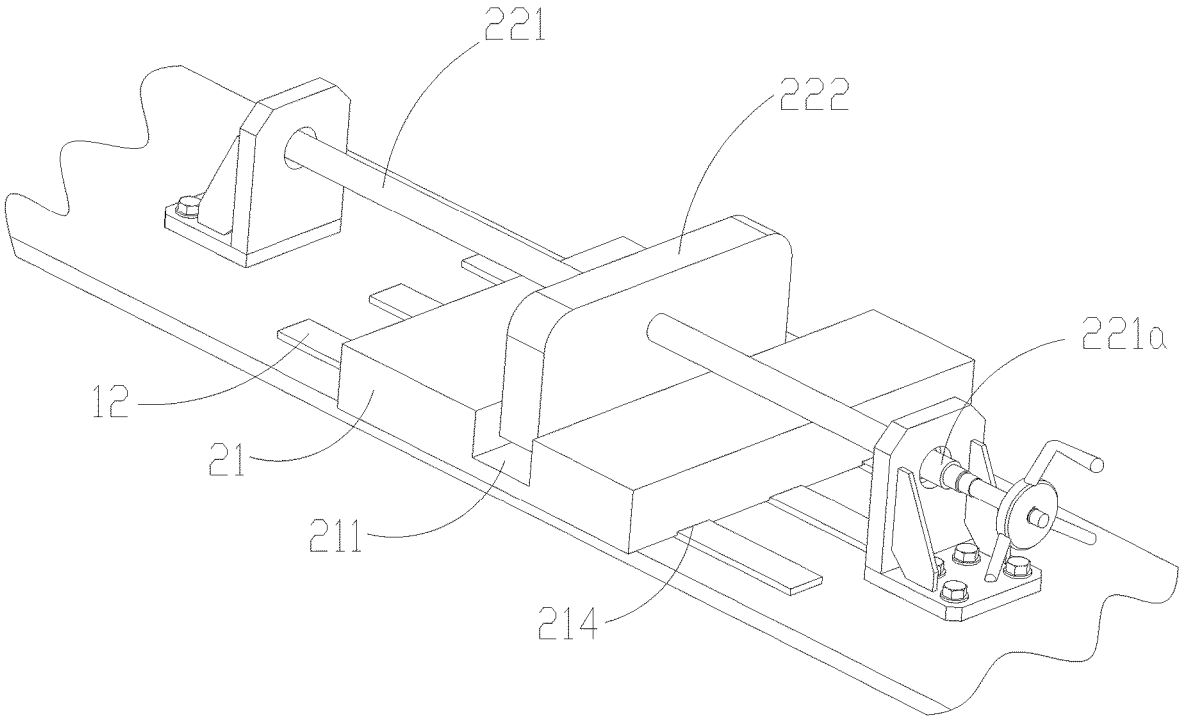
FIG. 6 is a partially enlarged view showing the structure of a lifting beam according to another embodiment of the present application.

Referring to FIG. 6, in some optional embodiments, the lifting member 21 includes a top plate which is movable along a top surface of the lifting beam, and an outer side surface of the top plate is provided with a groove 211, which is formed by the outer side surface of the top plate being concaved toward a bottom of the lifting member 21. The connecting member 222 is arranged in the groove 211 and is able to reciprocate in a concaving direction of the groove 211. In a case that the lifting member 21 deforms during the lifting process, the lifting member is able to move up and down in the groove 211 with respect to the connecting member 222, while a position of the connecting member 222 does not change, thereby protecting the connecting rod 221 connected to the connecting member 222 from elastically deforming.

It can be understood that, the connecting rod 221 may be connected to the connecting member 222 in various manners. As an embodiment in which the connecting rod 221 is connected to the connecting member 222, the connecting rod 221 is arranged at the connecting member 222 in a manner that the connecting rod is movable in the first direction. The connecting nut 222*b* or the connecting hole 222*a* is provided with internal threads, the connecting rod 221 is provided with external threads matching with the internal threads, and the connecting rod 221 is connected to the connecting nut 222*b* or the connecting hole 222*a* by threaded connection. Besides, since the fixed end 221*a* of the connecting rod 221 is fixed to the beam body 10, a position of the connecting member 222 with respect to the beam body 10 can be adjusted by screwing the connecting rod 221, thereby adjusting the position of the lifting member 21 connected to the connecting member 222 with respect to the beam body 10. The fixed end 221*a* of the connecting rod 221 may be fixed to the beam body 10 in various manners. For example, the beam body 10 is provided with a fixing seat, and the fixed end 221*a* of the connecting rod 221 is fixed to the beam body 10 through the fixing seat, wherein in order to facilitate screwing the connecting rod 221, the fixed end 221*a* extends out of the fixing seat and away from the connecting member 222 in the first direction, and an adjusting knob is provided at the fixed end 221*a*. In a case that the connecting rod 221 is connected to the connecting member 222 by threaded connection, an end of the connecting rod 221 away from the fixed end 221*a* is suspendingly arranged. In order to better protect the connecting rod 221 from damage, the beam body 10 is provided with a protection seat, the protection seat is provided with a through hole, the end of the connecting rod 221 away from the fixed end 221*a* is placed in the through hole, and a gap is kept between the through hole and the connecting rod.

Figure 7:
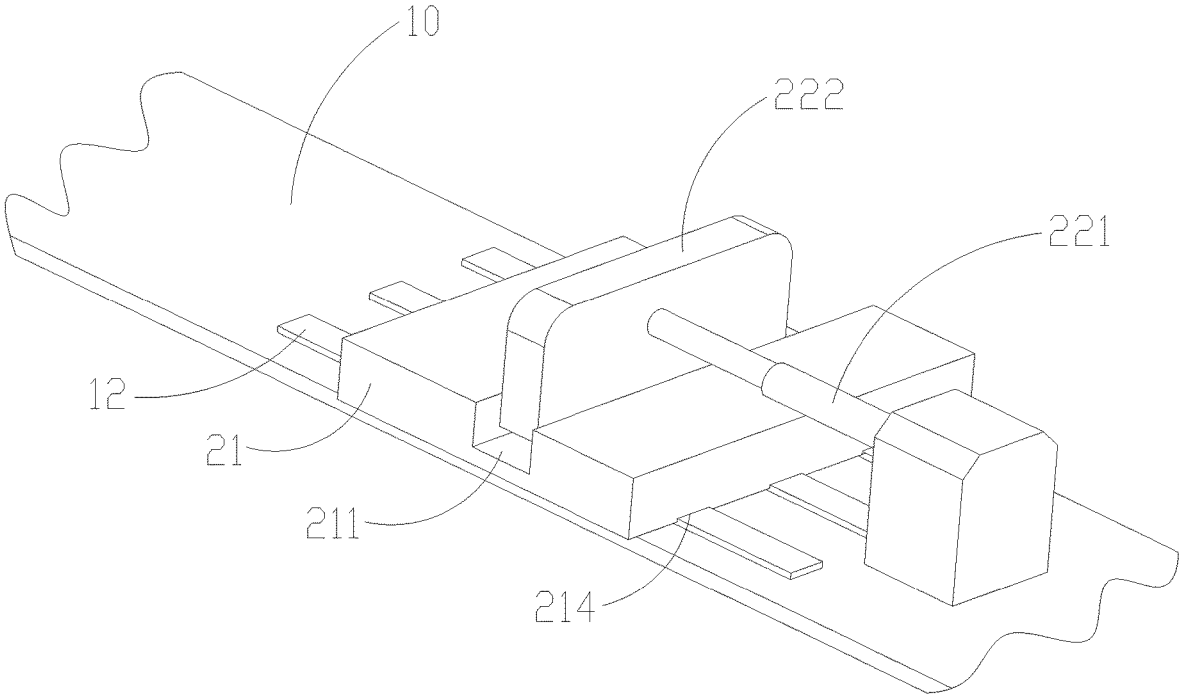
FIG. 7 is a partially enlarged view showing the structure of a lifting beam according to yet another embodiment of the present application.

Referring to FIG. 7, as another embodiment in which the connecting rod 221 is connected to the connecting member 222, the connecting rod 221 is a telescopic rod which is able to extend and contract in the first direction, and the end of the connecting rod 221 away from the fixed end 221*a* is fixed to the connecting member 222. In this case, the position of the connecting member 222 with respect to the beam body 10 can be adjusted by controlling a length of the connecting rod 221, thereby adjusting the position of the lifting member 21 connected to the connecting member 222 with respect to the beam body 10.

Figure 8:
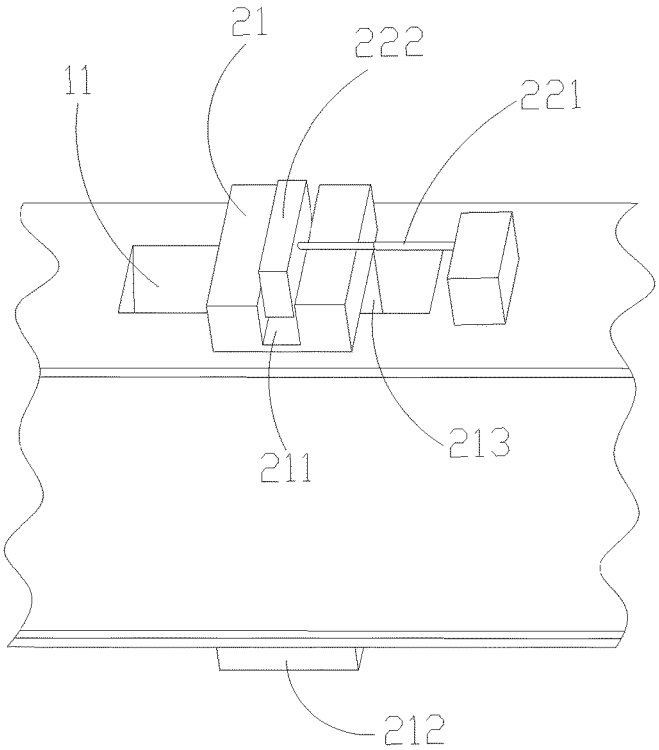
FIG. 8 is a partially enlarged view showing a structure of a lifting beam according to yet another embodiment of the present application.

Referring to FIG. 8, it can be understood that, there are various embodiments in which the lifting member 21 is fitted over the beam body 10 in a manner that the lifting member 21 is movable with respect to the beam body 10. For example, the lifting member 21 includes side plates and a through hole enclosed by the side plates, and the through hole of the lifting member 21 is fitted on an outer side of the beam body 10. Or, the beam body 10 includes a guiding hole 11 running through the beam body in an extending direction of the beam body, the lifting member 21 includes a stopping portion 212 and a connecting portion 213 connected with each other, the connecting portion 213 is movably arranged in the guiding hole 11, and the stopping portion 212 is arranged at one end of the connecting portion 213 and located at a bottom of the beam body 10, to prevent the lifting member 21 from being detached from the beam body 10 during the lifting process.

In order to avoid affecting the rigidity and strength of the beam body 10 itself, the lifting member 21 is fitted on the outer side of the beam body 10 through the through hole, a top outer surface of the beam body 10 is provided with a guiding rail 12 in the first direction, the bottom of the lifting member 21 is provided with a guiding portion 214 corresponding to the guiding rail 12, and the lifting member 21 is arranged to be movable along the guiding rail 12 through the guiding portion 214. The lifting member 21 is arranged to be movable along the guiding rail 12, which can effectively reduce a driving force required when the lifting member 21 is moved, thereby facilitating the adjustment of the position of the lifting member 21 with respect to the beam body 10. The guiding rail 12 and the guiding portion 214 may be arranged in various manners. For example, the guiding rail 12 is formed by the top surface of the beam body 10 protruding outward, and the guiding portion 214 is formed by the top plate of the lifting member 21 being concaved upward; or the guiding rail 12 is formed by the top surface of the beam body 10 being concaved inward, and the guide portion 214 is formed by the top plate of the lifting member 21 protruding outward, etc., as long as the guiding rail 12 and the guiding portion 214 can cooperate with each other, to allow the lifting member 21 to be movable along the beam body 10.

A lifting device including the lifting beam according to any one of the above embodiments is further provided according to the present application.

The present application may be embodied in other specific forms without departing from the spirit and essential characteristics thereof. For example, the algorithms described in the specific embodiments can be modified, while the structure of the system does not depart from the basic spirit of the present application. Therefore, the present embodiments are considered in all respects as illustrative rather than restrictive, the scope of the present application is defined by the appended claims rather than the above description, and all changes that fall in the meaning of the claims and the range of equivalents are intended to be included within the scope of the present application.

The invention claimed is:

1. A lifting beam, comprising:

a beam body extending in a first direction;

a lifting lug adjusting member; and lifting lugs; wherein the lifting lug adjusting member comprises a lifting member and an adjusting member connected with each other, the lifting member is movably fitted over the beam body, and the adjusting member is configured to adjust a position of the lifting member with respect to the beam body in the first direction; and the lifting lugs are arranged on the lifting member and are located above the beam body; wherein the adjusting member comprises:

a connecting rod arranged to extend in the first direction, wherein the connecting rod comprises a fixed end fixed to the beam body; and a connecting member connected to the connecting rod, wherein the connecting rod is connected to the lifting member via the connecting member in a manner that the lifting member is movable with respect to the connecting rod in a vertical direction.

2. The lifting beam according to claim 1, wherein the connecting member is provided with a connecting hole running through the connecting member in the first direction, the connecting hole is an oblong hole extending in the vertical direction, a connecting nut which is movable in an extending direction of the connecting hole is arranged in the connecting hole, and the connecting rod is connected to the connecting nut.

3. The lifting beam according to claim 2, wherein inner walls, facing the connecting hole, of the connecting member are provided with sliding rails in the extending direction of the connecting hole, and the connecting nut is arranged to be movable along the sliding rails.

4. The lifting beam according to claim 2, wherein the adjusting member further comprises a pretensioning piece, the pretensioning piece comprises a first pretensioning piece and a second pretensioning piece which are used in cooperation with each other, and pretensioning ends, close to the connecting nut, of the first pretensioning piece and the second pretensioning piece are configured to provide pretensioning forces for the connecting nut, to allow the connecting nut to be fixed to the connecting member in the first direction.

5. The lifting beam according to claim 4, wherein the pretensioning ends are provided with sliding rails in the extending direction of the connecting hole, and the connecting nut is movably arranged on the sliding rails.

6. The lifting beam according to claim 5, wherein an accommodation space configured to accommodate the connecting nut is formed between the first pretensioning piece and the second pretensioning piece, and the first pretensioning piece and the second pretensioning piece are arranged in a manner that the first pretensioning piece and the second pretensioning piece are movable with respect to each other, to change a size of the accommodation space.

7. The lifting beam according to claim 1, wherein the lifting member comprises a top plate which is movable along a top surface of the lifting beam, an outer side surface of the top plate is provided with a groove, which is formed by the outer side surface of the top plate being concaved toward a bottom of the lifting member, and the connecting member is arranged in the groove and is allowed to reciprocate in a concaving direction of the groove.

8. The lifting beam according to claim 1, wherein the connecting rod is arranged at the connecting member in a manner that the connecting rod is movable in the first direction.

9. The lifting beam according to claim 1, wherein the connecting rod is a telescopic rod which is movable in the first direction, and one end of the connecting rod opposite to the fixed end is fixed to the connecting member.

10. The lifting beam according to claim 1, wherein the lifting member comprises side plates and a through hole enclosed by the side plates, and the lifting member is fitted on an outer side of the beam body via the through hole.

11. The lifting beam according to claim 1, wherein the beam body comprises a guiding hole running through the beam body in an extending direction of the beam body, the lifting member comprises a stopping portion and a connecting portion connected with each other, the connecting portion is movably arranged in the guiding hole, and the stopping portion is arranged at an end of the connecting portion and located at a bottom of the beam body, to prevent the lifting member from being detached from the beam body during a lifting process.

12. The lifting beam according to claim 1, wherein a top outer surface of the beam body is provided with a guiding rail in the first direction, a bottom of the lifting member is provided with a guiding portion corresponding to the guiding rail, and the lifting member is arranged to be movable along the guiding rail through the guiding portion.

13. A lifting device, comprising the lifting beam according to claim 1.

* * * * *